US008549685B2

(12) United States Patent
Haye

(10) Patent No.: US 8,549,685 B2
(45) Date of Patent: Oct. 8, 2013

(54) CHILD SLEEPING RESTRAINT

(76) Inventor: Jovan Pierre Haye, Brentwood, TN (US)

( * ) Notice: Subject to any disclaimer, the term of this patent is extended or adjusted under 35 U.S.C. 154(b) by 228 days.

(21) Appl. No.: 13/004,216

(22) Filed: Jan. 11, 2011

(65) Prior Publication Data

US 2012/0174321 A1 Jul. 12, 2012

(51) Int. Cl.
*B68G 5/00* (2006.01)

(52) U.S. Cl.
USPC ..... 5/655; 5/655.9

(58) Field of Classification Search
USPC ..... 5/655, 424, 494, 636, 637; 128/869; 224/158
See application file for complete search history.

(56) References Cited

U.S. PATENT DOCUMENTS

| | | | | | |
|---|---|---|---|---|---|
| 1,504,030 | A | | 8/1924 | Dettweiler | |
| 2,429,283 | A | | 10/1947 | Veyt | |
| D211,335 | S | | 6/1968 | Kaussen | |
| 3,536,357 | A | | 10/1970 | Murcott | |
| 3,672,364 | A | * | 6/1972 | Rankin | 5/621 |
| 3,897,777 | A | * | 8/1975 | Morrison | 5/622 |
| 4,528,981 | A | * | 7/1985 | Behar | 5/637 |
| 5,159,727 | A | * | 11/1992 | McCracken | 5/655 |
| 5,224,637 | A | | 7/1993 | Colombo | |
| 5,367,730 | A | | 11/1994 | Sher | |
| 5,632,052 | A | * | 5/1997 | Michel | 5/655 |
| D389,359 | S | * | 1/1998 | Nowak | D6/601 |
| 6,023,802 | A | | 2/2000 | King | |
| 6,244,270 | B1 | * | 6/2001 | Lutian et al. | 128/869 |
| 6,954,955 | B2 | * | 10/2005 | Brewin et al. | 5/655 |
| 7,810,181 | B2 | | 10/2010 | Brewin | |
| 8,302,230 | B1 | * | 11/2012 | Jarrett et al. | 5/655 |
| 2005/0278854 | A1 | * | 12/2005 | Taricani, Jr. | 5/655 |
| 2006/0108855 | A1 | | 5/2006 | Watson | |
| 2008/0216244 | A1 | * | 9/2008 | Minton | 5/640 |
| 2010/0192304 | A1 | | 8/2010 | Kovalyak | |

FOREIGN PATENT DOCUMENTS

| | | |
|---|---|---|
| EP | 1665959 | 6/2006 |
| GB | 1385281 | 2/1975 |
| WO | 9826695 | 6/1998 |
| WO | 2011077401 | 6/2011 |
| WO | 2012096830 | 7/2012 |

OTHER PUBLICATIONS

Babybjorn, Baby Carriers Developed Together with Medical Experts, http://www.babybjorn.com/products/baby-carriers, last accessed Jan. 6, 2011, 1 page.
Ergobaby, Baby Carriers, http://www.ergobabycarriers.com/babycarriers/category/carrier, last accessed Jan. 6, 2011, 3 pages.

(Continued)

*Primary Examiner* — Robert G Santos
*Assistant Examiner* — Richard G Davis
(74) *Attorney, Agent, or Firm* — Shane V. Cortesi

(57) ABSTRACT

The present invention relates to a sleeping restraint for a child that can be used to secure the child to the chest of an adult who is in a substantially horizontal position as well as to methods of using a sleeping restraint. In certain embodiments, the sleeping restraint comprises a chest strap for encircling the chest of an adult, first and second child restraining walls extending from the chest strap, and a restraining strap attached to the first child restraining wall for restraining a child in place on the adult's chest between the walls when the adult is lying on his back.

10 Claims, 3 Drawing Sheets

(56) References Cited

OTHER PUBLICATIONS

Baby Age, Dex Products Secure Sleeper Ultra 3 in 1 Sleep Positioner, http://www.babyage.com/health-and-safety/dex-products-secure-sleeper-ultra-3-in-1-sleep-positioner-11584.htm, last accessed Dec. 17, 2010, 2 pages.
Baby Monitor, The First Years Airflow Wedge with Sleep Positioner, http://www.babymonitor.com/baby-sleep-soothers/baby-sleep-soothers/thefirstyearsairflowwedgewithsleeppositioner.cfm, last accessed Dec. 17, 2010, 2 pages.
Health Check Systems, Basic Comfort 91010 Head-N-Back Sleep Positioner, http://www.healthchecksystems.com/product/index.cfm?product_id=17520hoover22, last accessed Dec. 17, 2010, 2 pages.
International Search Report from WO2012096830.
Baby Monitor, The First Years Airflow Wedge with Sleep Positioner, http://www.babymonitor.com/baby-sleep-soothers/baby-sleep-soothers/thefirstyearsairflowwedgewithsleeppositioner.cfm, last accessed Jan. 27, 2012 (Screenshot), 1 Page.
Sleep Positioner Reviews, http://sleeppositionersreviews.blogspot.com/2010_09_01_archive.html, last accessed Jan. 27, 2012, 18 Pages.

* cited by examiner

CHILD SLEEPING RESTRAINT

BACKGROUND

1. Technical Field

The present invention relates to a sleeping restraint for securing a child to the chest of an adult who is in a substantially horizontal position as well as to methods of using a sleeping restraint.

2. Background of the Invention

There are a variety of apparatuses for securing children to adult caregivers. Such apparatuses include, without limitation, BabyBjorn® Baby Carrier Original, BabyBjorn® Baby Carrier Air, BabyBjorn® Baby Carrier Active, BabyBjorn® Baby Carrier Synergy, and BabyBjorn® Comfort Carrier marketed by BabyBjorn® of Bersharma, Sweden and Performance and Sport ERGObaby® carriers marketed by ERGObaby® of Maui, Hi.

However, such apparatuses often are both cumbersome and designed to be worn by an adult who is in an upright position—e.g., an adult who is standing or walking.

BRIEF SUMMARY

In certain aspects, the present invention provides a sleeping restraint that can be used to secure a child to an adult who is lying on his/her back. In one embodiment, the sleeping restraint comprises a chest strap for encircling an adult's chest, first and second child restraining walls, and a first restraining strap.

The chest strap has first and second strap ends and has a length sufficient to encircle an adult's chest. The first and second child restraining walls are spaced along the length of the chest strap and preferably extend from the chest strap such that when an adult is lying on the adult's back and the chest strap is encircling the adult's chest, the walls extend generally upwards for a distance of at least about 2 inches with respect to the adult's chest, along the length of the adult's body for a distance of at least about 2 inches and along the length of the chest strap for a distance of at least about 2 inches. The first restraining strap is attached to the first child restraining wall and functions to restrain a child in place on the adult's chest between the first and second child restraining walls when the adult is lying on the adult's back. Optionally, the sleeping restraint comprises a second restraining strap attached to the second child restraining wall, and the second restraining strap releasably attaches to the first restraining strap so that the first restraining strap and the second restraining strap both function to restrain a child in place on the adult's chest between the first and second child restraining walls when the adult is lying on the adult's back.

In certain embodiments, the sleeping restraint further comprises a connector for joining the first and second strap ends after the chest strap is placed around the adult's chest, as well as a base, which is attached to the chest strap and functions to receive a child.

In another embodiment, the invention provides a method for securing a child to an adult using the sleeping restraint. In certain aspects, the method includes:

a) encircling the chest strap around the chest of the adult;

b) positioning the adult in a substantially horizontal position such that the adult is lying on the adult's back;

c) positioning the first and second child restraining walls on the anterior portion of the adult's chest such that the first and second child restraining walls extend vertically upward with respect to the adult's chest and longitudinally along the length of the adult; and d) positioning a child of about 3 years of age or younger between the first and second child restraining walls.

DETAILED DESCRIPTION

Figure 1:
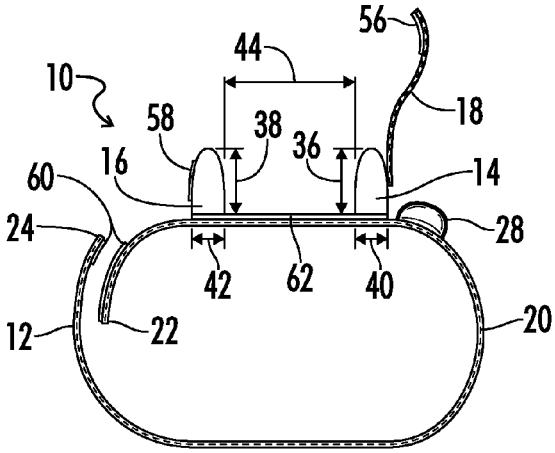
FIG. 1 illustrates a front, elevation view of a sleeping restraint in which the first and second strap ends of the chest strap have not been joined.

Referring now to the drawings, FIG. 1 illustrates a front, elevation view of one embodiment of a sleeping restraint generally designated by the numeral 10. In the drawings, not all reference numbers are included in each drawing for the sake of clarity. In addition, positional terms such as "height," "thickness," and "length" refer to the apparatus when in the orientation shown in the drawing.

Referring further to FIG. 1, in one embodiment, the sleeping restraint 10 comprises a chest strap 12, first and second child restraining walls 14 and 16 and a first restraining strap 18. The chest strap 12 has a strap length 20 and first and second strap ends 22 and 24.

Figure 7:
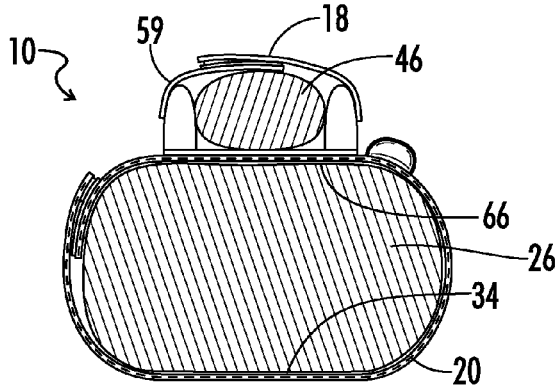
FIG. 7 illustrates a cross-sectional view of an adult who is lying on her back and using a sleep restraint to secure a child to the adult's chest.
Figure 8:
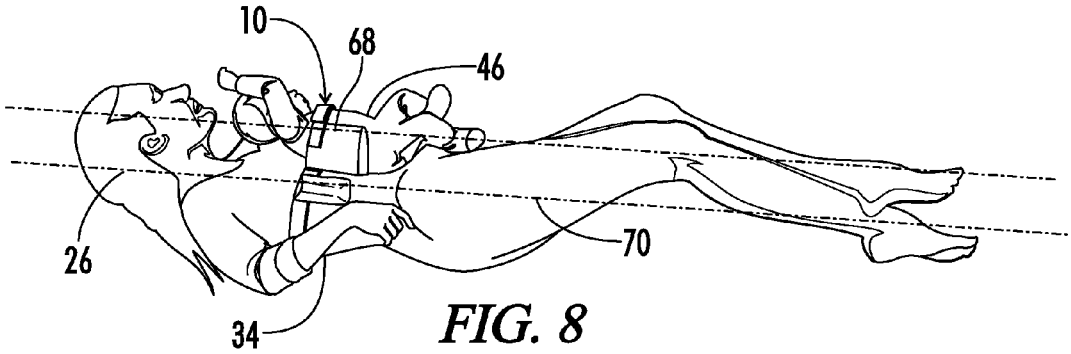
FIG. 8 illustrates a side view of an adult who is lying on her back and using a sleep restraint to secure a child to the adult's chest.

FIGS. 7 and 8 provide cross-sectional and side views, respectively, of the chest strap 12 encircling the chest of an adult human 26. As shown, the strap length 20 is a sufficient length to encircle the chest of an adult human 26. As used herein, the terms "adult human" and "adult" mean a human of about 6 years of age or older. Further, the terms "encircled", "encircles" or "encircling", when used to refer to the chest strap 12, mean that the chest strap 12 forms a substantially closed loop surrounding the chest of an adult human 26. Thus, preferably the strap length 20 of the chest strap 12 is from about 25 inches to about 55 inches.

Optionally, the chest strap 12 can further include a pocket 28, which can be used, for example, to hold a bottle, a pacifier, or a device that emits sounds such as a baby soother. The chest strap 12 can be comprised of any suitable material including, without limitation, fabric, leather, an elastic material, and nylon.

Figure 4:
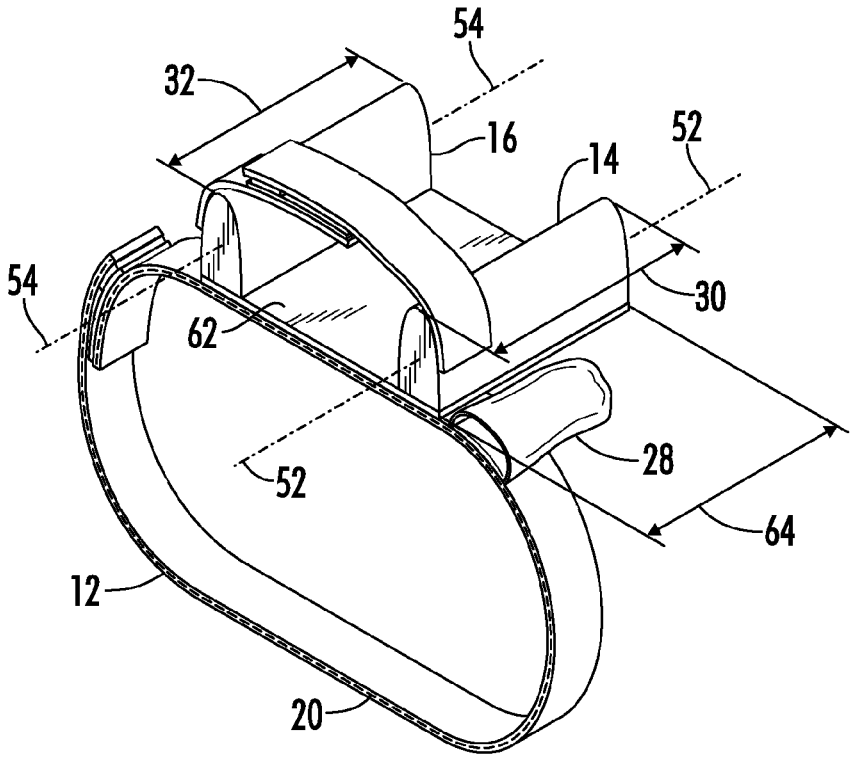
FIG. 4 illustrates a side, perspective view of a sleeping restraint that includes a base attached to the chest strap.

The sleeping restraint 10 further comprises first and second child restraining walls 14 and 16 extending from the chest strap 12. As shown in FIGS. 1 and 4, for example, the first and second child restraining walls 14 and 16 are spaced along the strap length 20 of the chest strap 12 and the first and second walls 14 and 16 each have a wall length 30 and 32 transverse to the strap length 20.

Preferably, the first and second child restraining walls 14 and 16 extend from the chest strap 12 such that when an adult 26 is lying on the adult's back 34 and the chest strap 12 is encircling the adult's chest, the walls 14 and 16 extend:

i) generally upwards for a distance of at least about 2 inches, more preferably a distance of from about 2 inches to about 8 inches, with respect to the adult's chest;

ii) along the length of the adult's body for a distance of at least about 2 inches, more preferably a distance of from about 2 inches to about 10 inches; and ii) along the strap length 20 of the chest strap 12 for a distance of at least about 2 inches, more preferably a distance of from about 2 inches to about 4 inches.

The first and second child restraining walls 14 and 16 can be any shape. Thus, as used herein, when it is mentioned that the walls 14 and 16 extend along the strap length 20 of the chest strap 12 for a distance of at least about 2 inches, it is meant that the maximum distance that each of the walls 14 and 16 extend along the strap length 20 of the chest strap 12 is at least about 2 inches.

For example, as shown in FIGS. 1 and 4, the first and second child restraining walls 14 and 16 each have a height 36 and 38 of from about 2 inches to about 8 inches, a maximum thickness 40 and 42 of from about 2 inches to about 4 inches, and a wall length 30 and 32 of from about 2 inches to about 10 inches.

As shown in FIGS. 1, 7 and 8, the average (mean) distance 44 between the first and second child restraining walls 14 and 16 is sufficient to allow a child 46 to lie lengthwise along the wall lengths 30 and 32 of the first and second child restraining walls 14 and 16.

As used herein, the terms "child" and "children" mean a human of less than about 6 years of age. Preferably, the sleeping restraint 10 allows a child of about 3 years of age or younger to lie lengthwise along the wall lengths 30 and 32 of the first and second child restraining walls 14 and 16. In an especially preferred embodiment, the child is about 1 year of age or younger. It will be appreciated that the distance between the walls 14 and 16 may vary along the wall lengths 30 and 32 and along the heights 36 and 38 of the walls 14 and 16. Preferably, the average (mean) distance 44 between the first and second child restraining walls 14 and 16 is from about 6 inches to about 14 inches.

Figure 6:
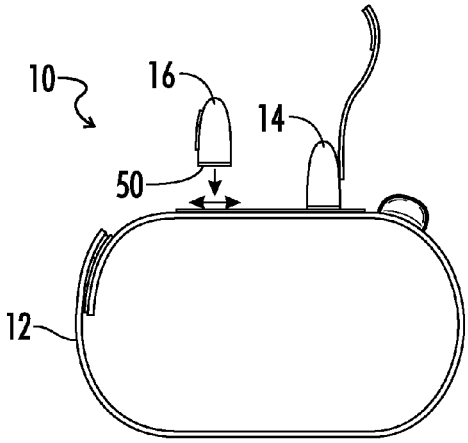
FIG. 6 illustrates a front, elevation view of a sleeping restraint in which the second child restraining wall is detached from the chest strap.

In certain embodiments, the average distance 44 between the first and second child restraining walls 14 and 16 is adjustable. For example, as shown in FIG. 6, in one embodiment, optionally, at least one of the first and second child restraining walls 14 and 16 are releasably attached to the chest strap 12 by a fastener 50 such as Velcro, a magnet, a button, a buckle, and/or a snap, such that the position of at least one of the first and second child restraining walls 14 and 16 along the strap length 20 of the chest strap 12 is adjustable. In yet another, embodiment, the size of at least one of the first and second child restraining walls 14 and 16, and hence the average distance 44 between the first and second child restraining walls 14 and 16, is adjusted by filling at least one of the first and second child restraining walls 14 and 16 with air or releasing air from at least one of the first and second child restraining walls 14 and 16.

The first and second restraining walls 14 and 16 can be any shape. Preferably, the first and second restraining walls 14 and 16 are generally cylindrical. If the first and second child restraining walls 14 and 16 are generally cylindrical, it is also preferred that the longitudinal axes 52 and 54 of the restraining walls 14 and 16 are transverse to the strap length 20 of the chest strap 12.

The first and second child restraining walls 14 and 16 can be formed from any material. For example, in one embodiment, the first and second child restraining walls 14 and 16 are formed from a compressible material, such as foam. In another embodiment, the first and second child restraining walls 14 and 16 are comprised of fabric.

In certain embodiments, the first and second child restraining walls 14 and 16 are substantially hollow. Preferably, if the first and second child restraining walls 14 and 16 are substantially hollow, one or more surfaces of the first and second child restraining walls 14 and 16 is comprised of a mesh material.

Figure 2:
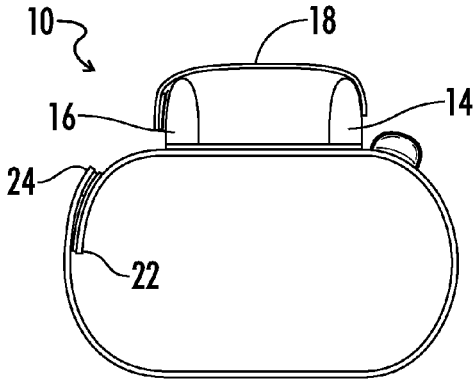
FIG. 2 illustrates a front, elevation view of a sleeping restraint in which the first and second strap ends have been joined by a connector and the first restraining strap is attached to the first and second child restraining walls.

The sleeping restraint 10 further comprises a first restraining strap 18 attached to the first child restraining wall 14 for restraining a child 46 in place on the adult's chest between the walls 14 and 16 when the adult 26 is lying on the adult's back 34. In one embodiment, the first restraining strap 18 releasably attaches to the second child restraining wall 16. For example, as shown in FIG. 2, the first restraining strap 18 can releasably attach to the second child restraining wall 16 through the use of a fastener, such as Velcro, a magnet, a button, a buckle, and/or a snap, positioned on the first restraining strap 18 and/or the second child restraining wall 16. In a preferred embodiment, a Velcro pad 56 is attached to the first child restraining strap 18 and a mating Velcro pad 58 is attached to the second child restraining wall 16. In another preferred embodiment, a snap is used to attach the first restraining strap 18 to the second child restraining wall 16.

Figure 3:
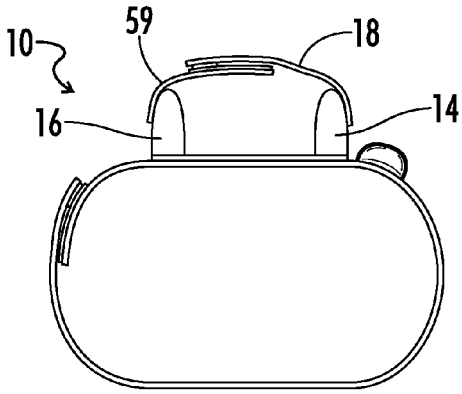
FIG. 3 illustrates a front, elevation view of a sleeping restraint in which the first and second strap ends have been joined by a connector and the first restraining strap is attached to the second restraining strap.

In another embodiment, as shown in FIG. 3, the sleeping restraint 10 includes a second restraining strap 59 attached to the second child restraining wall 16. In such an embodiment, the first and second restraining straps 18 and 59 releasably attach to each other through, for example, the use of a fastener, such as Velcro, a magnet, a button, a buckle, and/or a snap, positioned on the first restraining strap 18 and/or the second restraining strap 59.

Figure 5:
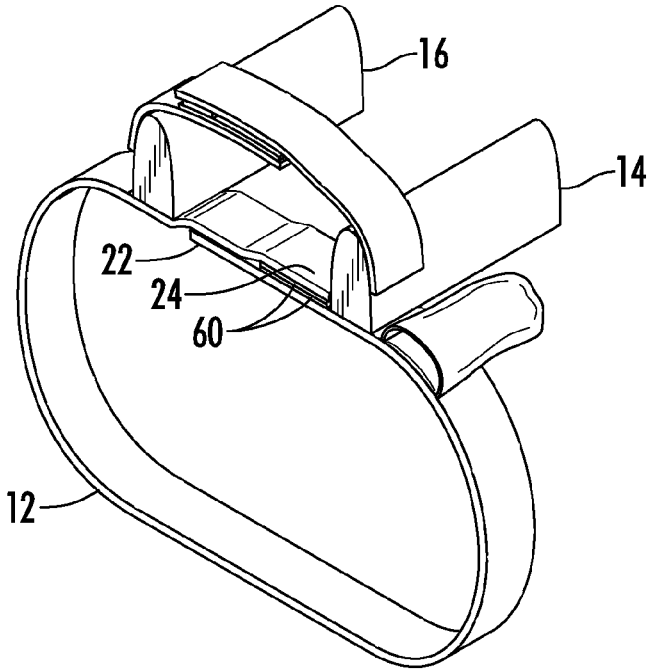
FIG. 5 illustrates a side, perspective view of a sleeping restraint that does not include a base attached to the chest strap.

Optionally, the sleeping restraint 10 further includes a connector 60 for joining the first and second strap ends 22 and 24 together after the chest strap 12 is placed around the adult's chest. The connector 60 can be any article or articles suitable for joining the first and second strap ends 22 and 24. For example, the connector 60 can be a fastener, such as Velcro, a magnet, a button, a buckle, and/or a snap. Preferably, the connector 60 is attached to the chest strap 12 and the connector 60 comprises mating Velcro pads that are attached to the chest strap 12. Optionally, as shown in FIG. 5, the first and second strap ends 22 and 24 can join between the first and second child restraining walls 14 and 16.

The sleeping restraint 10 optionally further includes a base 62 for receiving a child 46. If included, the base 62 is attached to the chest strap 12 and the base 62 has a base length 64 transverse to the strap length 20. Preferably, in such an embodiment, the first and second child restraining walls 14 and 16 are attached to the base 62 so that when the adult 26 is lying on the adult's back 34, the first and second child restraining walls 14 and 16 extend generally upward from the adult's chest and along the base 62 transverse to the strap length 20. It is also preferred that the base 62 separates the first and second child restraining walls 14 and 16 from the chest strap 20.

The base 62 can any shape or size. Preferably, the base 62 extends at least about 10 inches along the strap length 20 of the chest strap 12, and at least about 6 inches transverse to the strap length 20 and along the wall lengths 30 and 32 of the first and second child restraining walls 14 and 16.

The sleeping restraint 10 can be used in a method for securing a child 46 to an adult 26. For example, the sleeping restraint 10 can be used to secure a child 46 to an adult 26 lying in a substantially horizontal position on, for example, a floor, a bed or a couch. However, it will be appreciated that such surfaces are merely exemplary.

In an embodiment, a method for using the sleeping restraint 10 to secure a child 46 to an adult 26 includes:

A) encircling the chest strap 12 around the chest of the adult 26;

B) positioning the adult 26 in a substantially horizontal position such that the adult 26 is lying on the adult's back 34;

C) positioning the first and second child restraining walls 14 and 16 on the anterior portion 66 of the adult's chest such that the first and second restraining walls 14 and 16 extend vertically upward with respect to the adult's chest and longitudinally along the length of the adult 26; and D) positioning a child 46 of about 3 years of age or younger between the first and second restraining walls 14 and 16.

Steps A-D described above can be performed in any suitable order or simultaneously. For example, Step C can be performed simultaneously with Step A, by encircling the chest strap 12 around the adult's chest such that the first and second child restraining walls 14 and 16, which extend from the chest strap 12, are positioned on the anterior portion 66 of the adult's chest and extend vertically upward with respect to the adult's chest and longitudinally along the length of the adult 26.

In certain embodiments, the method further includes attaching the first restraining strap 18 to the second child restraining wall 16. Alternatively, as mentioned, the sleeping restraint 10 can further comprise a second restraining strap 59, in which case the method can further include attaching the first restraining strap 18 to the second restraining strap 59.

Preferably, a child 46 is positioned between the first and second child restraining walls 14 and 16 such that the longitudinal axis 68 of the child 46 is substantially parallel to the longitudinal axis 70 of the adult 26. As known to those of ordinary skill, the longitudinal axis of the human body is a straight line that runs through the body's center of gravity and extends through the head and the space between the feet of the human. It is also preferred that the first and second child restraining walls 14 and 16 are generally cylindrical in shape and the longitudinal axes 52 and 54 of the first and second child restraining walls 14 and 16 are substantially parallel to the longitudinal axis 70 of the adult 26 when the adult 26 is lying on his back 34 and the chest strap 12 is encircled around the chest of the adult 26.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims.

What is claimed is:

1. A method for securing a child to an adult using a sleeping restraint comprising a chest strap having two strap ends and a strap length, first and second child restraining walls extending from the chest strap, the walls each having a wall length transverse to the strap length, and a first restraining strap extending from the first child restraining wall, the method comprising the steps of:

encircling the chest strap around the chest of the adult;

positioning the adult in a substantially horizontal position such that the adult is lying on the adult's back;

positioning the first and second child restraining walls on the anterior portion of the adult's chest such that the first and second child restraining walls extend vertically upward with respect to the adult's chest and longitudinally along the length of the adult; and positioning a child of about 3 years of age or younger between the first and second child restraining walls.

2. The method of claim 1, further comprising the step of:

e) attaching the first restraining strap to the second child restraining wall.

3. The method of claim 1, wherein the second child restraining wall further comprises a second restraining strap and the method further comprises the step of:

e) attaching the first restraining strap to the second restraining strap.

4. The method of claim 1, wherein the child is positioned between the first and second child restraining walls such that the longitudinal axis of the child is substantially parallel to the longitudinal axis of the adult.

5. The method of claim 1, wherein the first and second child restraining walls are generally cylindrical in shape and the longitudinal axes of the first and second child restraining walls are substantially parallel to the longitudinal axis of the adult when the adult is lying on his back and the chest strap is encircled around the chest of the adult.

6. The method of claim 1, wherein each of the first and second child restraining walls extend at least about 2 inches along the length of the chest strap.

7. The method of claim 1, wherein each of the first and second child restraining walls extend at least about 2 inches vertically upward with respect to the adult's chest, when the adult is lying on the adult's back and the first and second child restraining walls are positioned on the anterior portion of the adult's chest.

8. The method of claim 1, wherein each of the first and second child restraining walls extend longitudinally for at least about 2 inches along the length of the adult, when the adult is lying on the adult's back and the first and second child restraining walls are positioned on the anterior portion of the adult's chest.

9. The method of claim 1, wherein the child's head is positioned between the top of the adult's head and the first and second child retraining walls.

10. A method for securing a child to an adult comprising the steps of:

a) providing a sleeping restraint comprising:

i) a chest strap for encircling an adult's chest, the chest strap having a strap length and first and second strap ends;

ii) a connector for joining the first and second strap ends together after the chest strap is placed around the adult's chest;

iii) first and second child restraining walls extending from the chest strap so that when the adult is lying on the adult's back and the chest strap is encircling the adult's chest, the walls extend generally upwards from the adult's chest, the walls being spaced along the length of the chest strap, the walls each having a wall length transverse to the strap length and first and second ends at opposite ends of the wall length; and d) a restraining strap attached to the first child restraining wall for restraining a child in place on the adult's chest between the walls when the adult is lying on the adult's back, wherein the first and second child restraining walls are substantially hollow and at least one of the first and second ends of each of the first and second child restraining walls is comprised of a mesh material;

b) encircling the chest strap around the adult's chest, the chest strap having a strap length and first and second strap ends;

c) positioning the first and second child restraining walls on the anterior portion of the adult's chest; and d) positioning a child between the first and second child restraining walls.

* * * * *